US005899004A

United States Patent [19]

Sugaoka et al.

[11] Patent Number: 5,899,004

[45] Date of Patent: May 4, 1999

[54] WOOD SMOKING-SEASONING METHOD

[75] Inventors: Kenji Sugaoka, Towada; Shin Niiyama, Gonohe-Machi; Hitoshi Sugaoka; Taku Sugaoka, both of Towada, all of Japan

[73] Assignee: Kodaijin Sugaoka Ltd., Aomori, Japan

[21] Appl. No.: 08/945,007

[22] PCT Filed: Sep. 30, 1996

[86] PCT No.: PCT/JP96/02839

§ 371 Date: Oct. 9, 1997

§ 102(e) Date: Oct. 9, 1997

[87] PCT Pub. No.: WO97/29894

PCT Pub. Date: Aug. 21, 1997

[30] Foreign Application Priority Data

Feb. 19, 1996 [JP] Japan ..... 8-53697

[51] Int. Cl.[6] ..... F26B 7/00

[52] U.S. Cl. ..... 34/396; 34/417; 34/477; 34/494; 34/497

[58] Field of Search ..... 346/396, 411, 346/412, 417, 476, 477, 478, 479, 494, 497, 201, 202, 218; 110/102, 224, 234, 254; 427/351

[56] References Cited

U.S. PATENT DOCUMENTS 1,413,018 4/1922 Fujino ..... 34/396 X
4,182,048 1/1980 Wolfe et al. ..... 34/396
4,486,475 12/1984 Shutov et al. ..... 427/351
5,293,700 3/1994 Ishii ..... 34/225

*Primary Examiner*—Henry Bennett
*Assistant Examiner*—Steve Gravini
*Attorney, Agent, or Firm*—McGlew and Tuttle, P.C.

[57] ABSTRACT

A furnace is set to the floor section where wastes such as wood chips, scrapped wood, or wood pieces are put, flammable wastes such as planer chips, plane chips, bark, branches and leaves, or waste paper are arranged as an ignition material so as to cover the upper and lower sides of the wastes. Several resistant steel lids are lain one upon another on the upper side of the furnace so that heat and smoke can pass through the gap between the lids. The ignition material is ignited and inside combustion material is incompletely burned keeping the central portion of green-wood stacked on the upper side in a range of 75 to 80° C. The green-wood is smoking-seasoned at a low temperature by supplying smoke and hot air to the wood and the stacked wood is seasoned at a low temperature by convection blowers arranged at various positions in the indoor temperature adjusting damper and the room. Then the wood is left as it is until the difference between the core temperature of the wood and the outside air temperature comes to 5° C. or less and thereafter, the shutter in the room is opened to bring out the wood.

5 Claims, 2 Drawing Sheets

WOOD SMOKING-SEASONING METHOD

BACKGROUND OF THE INVENTION

1. Field of the Invention

The present invention relates to a seasoning method for wood used as a building material of a structure or a component material of fittings.

2. Description of the Prior Art

The conventional wood seasoning method is roughly divided into natural seasoning and artificial seasoning. Artificial seasoning includes a seasoning method using a heat source of gas, electricity, or steam, a reduced-pressure seasoning method using heating or high frequency, and a dehumidification seasoning method.

Because natural seasoning is a method of putting green wood at a well-ventilated place to naturally season the wood, it requires a lot of seasoning days and has a disadvantage that the number of seasoning days cannot be determined because it is subject to weather. Moreover, the wood becomes heterogeneous because its moisture content cannot be kept constant and moreover, the wood cannot be seasoned up to a certain moisture content or less. Therefore, wood used is dried due to air conditioning in a room after built and resultingly, structures or fittings are deformed.

In the case of artificial seasoning, it is possible to decrease the number of seasoning days, specify the number of seasoning days, and obtain wood with a low moisture content, and comparatively small warps, cracks or deformation because this method is not influenced by weather. However, the costs for a heat source and equipment increase.

In the case of seasoning using gas or electricity as a heat source or using steam, temperature and humidity can easily be adjusted. However, the equipment cost and energy cost increase and problems lie in the durability of equipment including a furnace and machinery.

Reduced-pressure seasoning is performed by reducing pressure and thereby lowering the boiling point of water (approx. 41° C.). When the seasoning temperature exceeds 80° C., wood fiber is swelled and broken. In other words, strength deterioration occurs. In the case of this method, when the wood temperature lowers due to sudden seasoning, the seasoning speed decreases. Therefore, an effective seasoning time is up to approx. 2 hours. Moreover, because wood temperature unevenness occurs in stacked wood when the wood temperature rises and thereby, unevenness of moisture content occurs in finished wood.

In the case of dehumidification seasoning, equipment is simple and its operation is also easy. However, seasoning time increases.

BRIEF SUMMARY OF THE INVENTION

Object of the Invention

The present invention uses industrial wastes such as sawdust, planer chips, wood chips, scrapped wood, and wood pieces as combustion materials and incompletely burn them to perform low-temperature smoking-seasoning. Therefore, it is possible to decrease the energy cost by using wastes and manufacture the wood having a small occurrence rate of warps or cracks, mildewproof property, insectproof effect, and high rotproof effect.

This is because aldehyde contained in smoke combines with lignin contained in wood together with cellulose to coagulate lignin, and the cellulose density of the core of the wood is higher than that of the surface of the wood and therefore the core temperature becomes higher than the surface temperature, seasoning unevenness between inside and outside of the wood is eliminated, and resultingly the number of warps or cracks decreases. Moreover, phenolic acid which is one of the components in smoke and serves as a material for naphthalene shows the mildewproof property and insectproof effect and aldehyde shows the rotproof effect. Furthermore, organic substances in smoke increases the strength of cellulose which is also referred to as the backbone of wood, makes grain beautiful, and makes the movement of a plane or saw smooth.

DETAILED DESCRIPTION OF THE PREFERRED EMBODIMENTS

Figure 1:
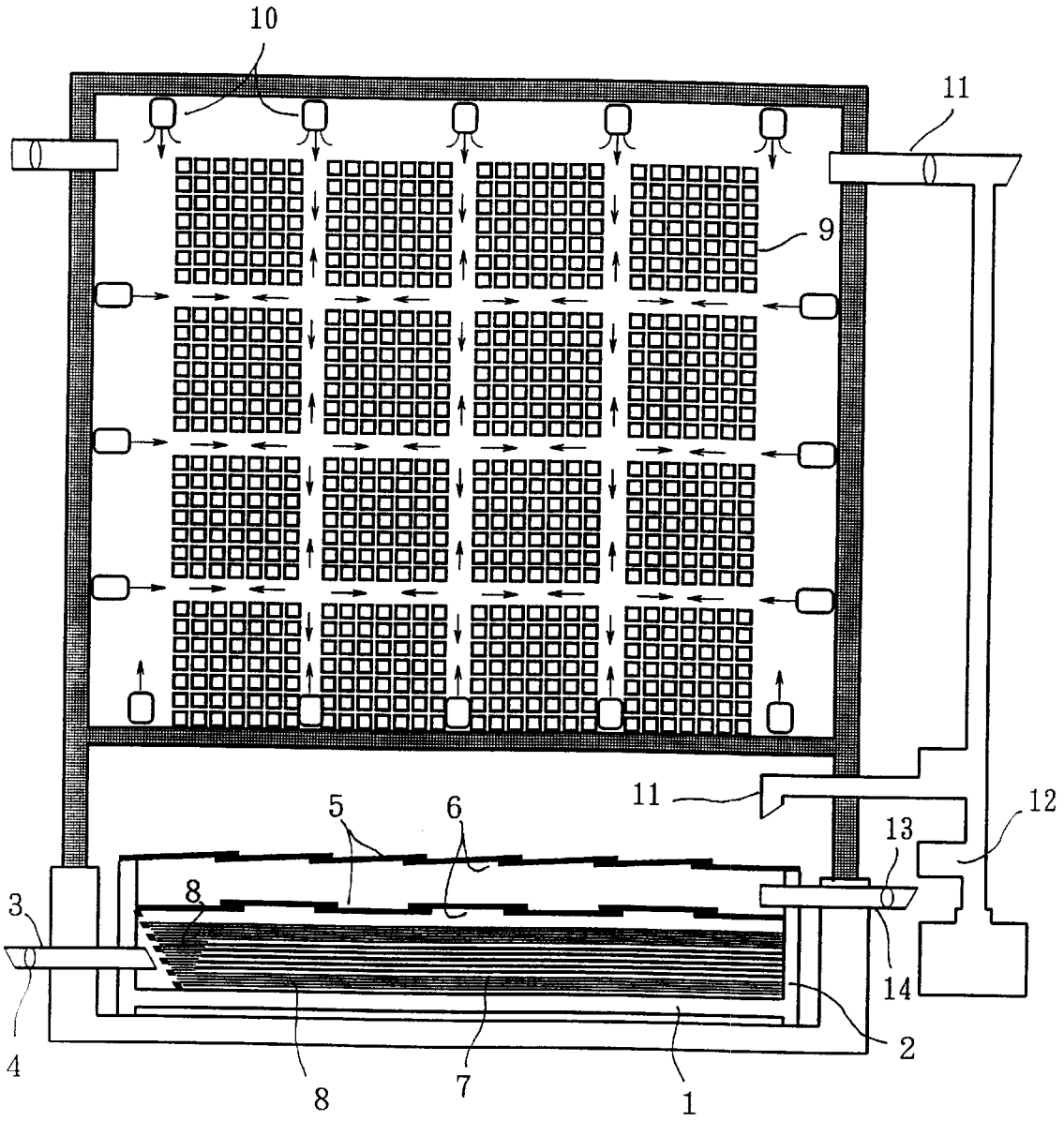
FIG. 1 is a schematic view showing a general structure.
Figure 2:
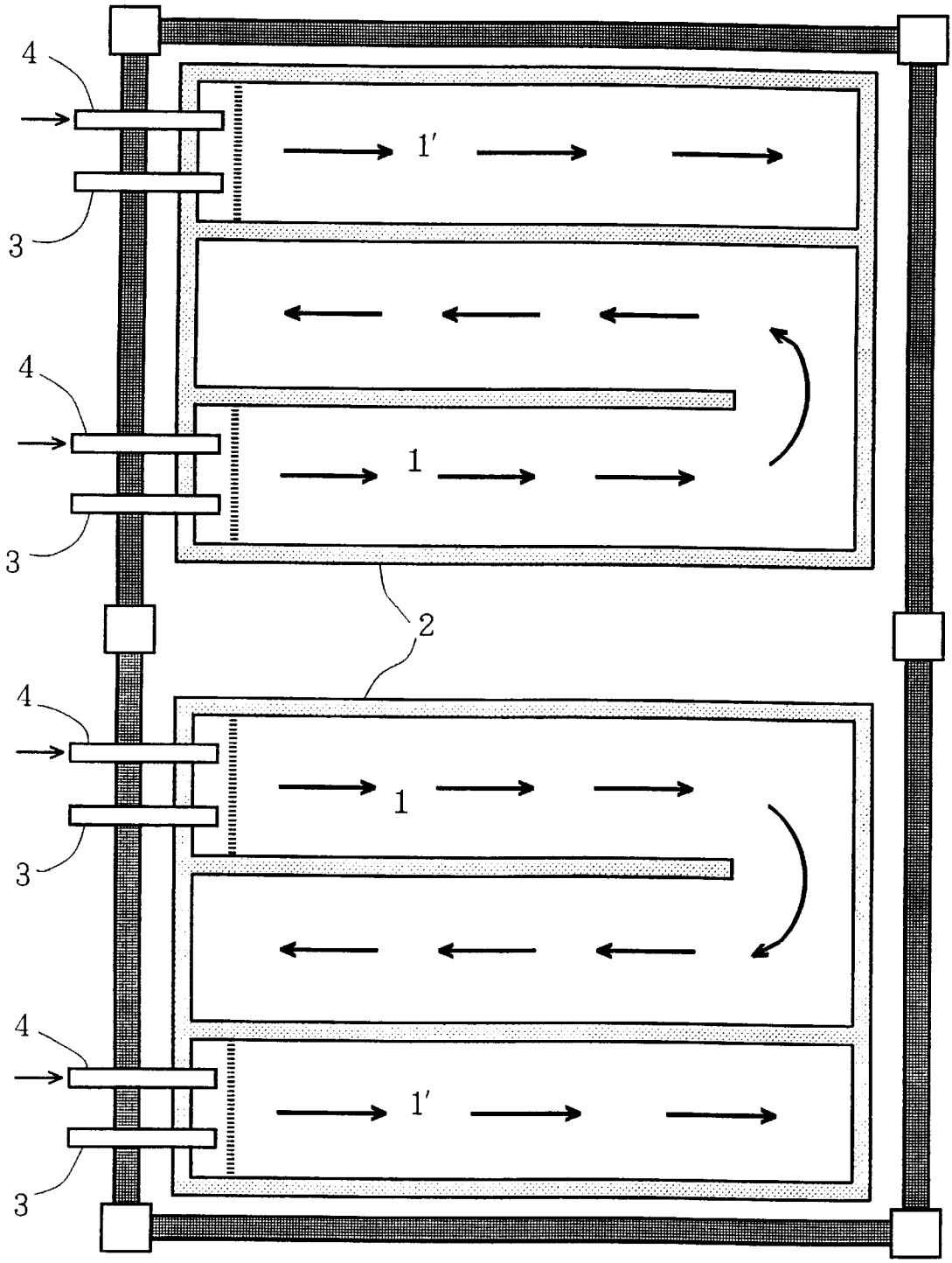
FIG. 2 is a top view of a furnace.

In the case of a system used for the present invention, a furnace is set to the floor section in a fire-resistant room, a green-wood stacking section is formed at the center in the room, a proper number of convection fans are set at proper positions in the room, and an air adjusting hole is formed on the furnace wall.

Wastes such as wood chips, scrapped wood, or wood pieces are put in the furnace, flammable wastes such as planer chips, plane chips, bark, branches and leaves, or waste paper are arranged as an ignition material so as to cover the upper and lower sides of the wastes, and two heat-resistant steel lids are put on the upper side so that heat and smoke can pass through the gap between the two lids. When the ignition material is ignited, fire expands on the whole surface and inside combustion material is burned. The amount of air is adjusted by a combustion air adjusting damper or by forcibly supplying carbon dioxide or oxygen so that the temperature detected by the sensors set in the room and to the central portion of wood is kept in a range of 75 to 80° C. and thereby, incomplete combustion is performed and the wood stacked on the upper side is smoking-seasoned at a low temperature by supplying smoke and hot air to the wood. The stacked wood is seasoned at a low temperature for three days in summer or five days in winter by uniformly circulating smoke and hot air through the wood by convection blowers arranged at various positions in the indoor temperature adjusting damper and the room.

After seasoning, the wood is left as it is until the difference bet ween the core temperature of the wood and the outside air temperature comes to 5° C. or less and thereafter, the shutter in the room is opened to bring out the wood. It is advantageous to bring in or out the wood by running a portal crane or the like on the rails.

It is advantageous to arrange two or three furnaces so that combustion can sequentially be continued because combustion can be controlled correspondingly a change of the quantity or moisture content, that is, seasoning period can be controlled. It is easier to control combustion or seasoning period by an auxiliary smoking furnace partitioned and arranged adjacently to a main smoking furnace.

Indoor inflation due to heat occurs at the time of seasoning. Therefore, an exhaust duct having a regulating valve is set so as to correspond to the indoor inflation. Moreover, smoke is simultaneously discharged from the exhaust duct. Therefore, the exhaust gas is sent to a cooler and smoked liquid is collected to extract wood vinegar. This liquid contains components effective for insect proofing, rot proofing, and sterilization. By applying the liquid to the surface of processed wood, it is possible to obtain wood having the above effects further improved.

According to the seasoning method of the present invention, low-temperature smoking-seasoning is realized, the fuel cost is reduced by using wastes, and a product free from warp or crack is obtained.

Moreover, burned wastes are used as charcoal or wood ash and can be reused again as the fertilizer for organic agriculture.

The present invention is described below in accordance with an embodiment shown in the accompanying drawings.

Three main smoking furnaces 1 and three auxiliary smoking furnaces 1' are arranged on floor surface A or under the floor in a room of 150 to 200 m3 constructed with fireproof walls by partitioning them with partitions 2 made of a heat insulating material. The main smoking furnaces are continued while a part of each partition 2 is removed at the front end. Ignition 3 and air control valve 4 are set to each furnace from the outside. Iron lids 5 are horizontally arranged on the top of each furnace 1 while they are overlapped each other so as to cover the whole surface of each furnace. When occasion demands, lids 5' are doubly set at intervals and duct 14 of exhaust gas temperature adjusting damper 13 is connected between them. Lids 5 can be superposed at the top or bottom as long as gap 6 is formed at the both sides.

Combustion material 7 such as wood chips, scrapped wood, or wood pieces is set to the central portion of furnace 1 and then, furnace 1 is packed with flammable wastes such as planer chips, plane chips, bark, branches and leaves, or waste paper as ignition material 8. The total amount of ignition material 8 reaches approx. 15 $m^3$ .

Wood 9 such as green wood or sawing lumber is stacked up to approx. 150 $m^3$ equivalent to the volume of 1 to 3 buildings at the center of the room above furnace 1. Stacking represents piling pieces of wood so as to have gaps in both horizontal and vertical directions.

After the above preparation is completed, ignition material 8 inserted to the surface in the furnace is ignited by an ignitor through ignition duct 3 connected into the furnace from the outside. Fire of ignition material 8 spread along the surface of the combustion material and reaches combustion material 7. The amount of air in the furnace is adjusted by opening or closing the adjusting valve set to air adjusting damper 4 or combustion of the auxiliary smoking furnace is adjusted to perform incomplete combustion, thereby produce smoke, and send smoke into the room through gap 6 between lids. At the same time, temperature is detected by the sensors arranged in the room and the central portion of wood to keep the temperature in the room in a range of 75 to 80° C. Distributions of smoke and temperature in the room are homogenized by convection flows 10 set at various positions in the room to smoking-season the wood at a low temperature for 10 days in summer or 12 days in winter in accordance with the type of the wood or season. Finally, the wood is left as it is until the difference between the temperature in the room, the outside air temperature, and the core temperature of the wood comes to 8° C. or lower and thereafter, the shutter of the room is opened to complete the process.

Moreover, exhaust duct 11 is used to avoid the danger due to indoor inflation and provided with cooler 12 so that wood vinegar can be extracted from smoke by liquefying exhaust gas.

Because the present invention performs low-temperature smoking seasoning at 75 to 80° C., aldehyde contained in smoke combines with lignin contained in cellulose of wood to produce heat. Therefore, the temperature in the wood becomes higher than the temperature in the room, the surface and inside of the wood are homogeneously seasoned, and resultingly the wood free from cracks, having beautiful grain, and smoothing the movement of a plane or saw can be obtained. The above phenomena occur because aldehyde has a function for coagulating protein and the density of protein of the core of wood is higher than that of the surface of the wood. Moreover, phenolic acid which is one of the components in smoke and serves as a material for naphthalene shows the mildewproof property and insect-proof effect and aldehyde shows the rotproof effect.

Furthermore, the present invention makes it possible to greatly decrease the number of seasoning days compared to the conventional natural seasoning.

Furthermore, the present invention makes it possible to manufacture an alcove post on which spots of blue mold appear as a special pattern by peeling a Japanese ceder log and covering it with a plastic sheet after the log surface becomes slippery to grow blue mold and thereafter, smoking-seasoning the log. When using a Japanese red pine, a beautiful alcove post can be obtained by smoking-seasoning the pine with bark at a low temperature for one week and thereafter peeling the pine.

Above all, the present invention makes it possible to reduce fuel consumption because wastes are used as ignition and combustion materials and moreover re-reuse the wastes as fertilizer for organic agriculture because the wastes are changed to charcoal or wood ash through incomplete combustion.

What is claimed is:

1. A wood smoking-seasoning method using a furnace on floor section in a heat-resistant room, a green-wood stacking section formed at the central portion in said room, a convection blower set at a proper position in said room, and temperature sensors arranged in said room and the central portion of wood;

the method comprising the steps of: putting waste wood in said furnace;

covering the surface of said waste wood with wastes as an ignition material;

closing said furnace with its cover;

incompletely burning the objects in said furnace after they are ignited by adjusting the amount of air in an exhaust duct;

keeping the temperature in said room in a range of 75 to 80° C., circulating smoke and hot smoke by said convection;

blower to season the wood to be dried by smoking at a low temperature for 3 to 5 days in accordance with the outside air temperature;

and leaving the wood as it is until the temperature difference between the temperature in said room, the temperature of outside air, and the temperature of the central portion of said wood comes to 5° C. or less.

2. The wood smoking-seasoning method according to claim 1, further comprising:

extracting wood vinegar by setting a cooler to said exhaust duct and coating the surface of said wood with said wood vinegar after smoking-seasoning to protect it from rot or insects.

3. A wood smoking-seasoning method comprising the steps of:

providing a furnace with a cover;

inserting waste wood in said furnace;

covering a surface of said waste wood an ignition material;

closing said cover of said furnace;

providing a room with wood to be seasoned;

incompletely burning said waste wood in said furnace;

circulating smoke and heat from said incomplete burning through said wood to be seasoned until a temperature of said wood to be seasoned is substantially 75 to 80 degrees Celsius;

maintaining said wood to be seasoned in said room until a difference between an inside and outside of said wood to be seasoned is less than or equal to 5 degrees Celsius.

4. A method in accordance with claim 3, further comprising:

cooling said smoke from said incomplete burning to extract wood vinegar;

coating a surface of said wood to be seasoned with said wood vinegar.

5. A method in accordance with claim 3, wherein:

said waste wood is one of wood chips, scrapped wood and wood pieces;

said ignition material is one of planer chips, plane chips, bark and waste paper.

* * * * *